United States Patent [19]

White

[11] 4,413,719

[45] Nov. 8, 1983

[54] METHOD AND APPARATUS FOR ENTRAPMENT PREVENTION AND LATERAL GUIDANCE IN PASSENGER CONVEYOR SYSTEMS

[76] Inventor: Carl J. White, 5000 SW. 80th St., Miami, Fla. 33143

[21] Appl. No.: 268,022

[22] Filed: May 28, 1981

[51] Int. Cl.[3] ..... B66B 9/12

[52] U.S. Cl. ..... 198/333

[58] Field of Search ..... 198/333, 326

[56] References Cited

U.S. PATENT DOCUMENTS

| | | | |
|---|---|---|---|
| 2,535,501 | 12/1950 | Loughridge . | |
| 2,813,613 | 11/1957 | Margles | 198/333 |
| 2,981,397 | 4/1961 | Hansen . | |
| 3,144,118 | 8/1964 | Fabula . | |
| 3,191,743 | 6/1965 | Rissler et al. . | |
| 3,986,595 | 10/1976 | Asano et al. | 198/333 |
| 4,236,623 | 12/1980 | Ackert | 198/333 |

FOREIGN PATENT DOCUMENTS

| | | |
|---|---|---|
| 1100894 | 8/1956 | Fed. Rep. of Germany . |
| 2161442 | 12/1971 | Fed. Rep. of Germany . |
| 2557226 | 12/1975 | Fed. Rep. of Germany . |
| 2518440 | 4/1975 | Fed. Rep. of Germany . |
| 2642149 | 9/1976 | Fed. Rep. of Germany . |
| 5218685 | 8/1975 | Japan . |
| 5261092 | 11/1975 | Japan . |
| 52-41378 | 4/1976 | Japan . |
| 52-41379 | 4/1976 | Japan . |
| 519149 | 10/1938 | United Kingdom . |
| 1165867 | 9/1968 | United Kingdom . |
| 1276922 | 2/1969 | United Kingdom . |

*Primary Examiner*—John J. Love
*Assistant Examiner*—Paul A. Sobel
*Attorney, Agent, or Firm*—Jones, Tullar & Cooper

[57] ABSTRACT

Method and apparatus for minimizing the running clearance gap between stationary skirt panels and moving steps or segments of a passenger conveyor such as an escalator or moving walk, and simultaneously providing lateral guidance for the moving conveyor steps or segments, to thus reduce wear, noise, and vibration, wherein the skirt panels serve as guides for low friction, abrasion-resistant, resilient plastic bearing plates disposed on each side of the passenger conveyor steps or segments. In a second embodiment, which may be used with or without step bearing plates, raised curb members, which are attached to both sides of escalator step treads to minimize the gap between the moving escalator steps and adjacent stationary skirt panels, are shaped so that when an escalator passenger steps upon this curb member, it is firmly pressed against the adjacent skirt panel.

27 Claims, 21 Drawing Figures

FIG. 5
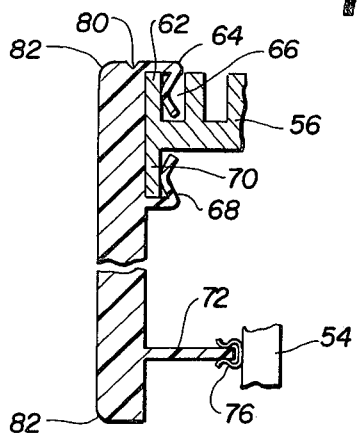
FIG. 8
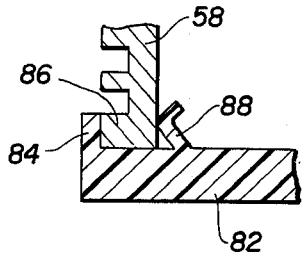
FIG. 9
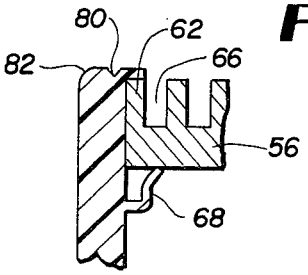
FIG. 10
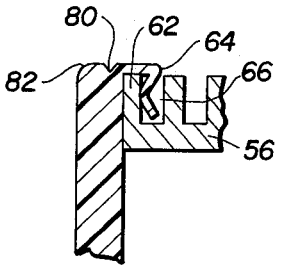
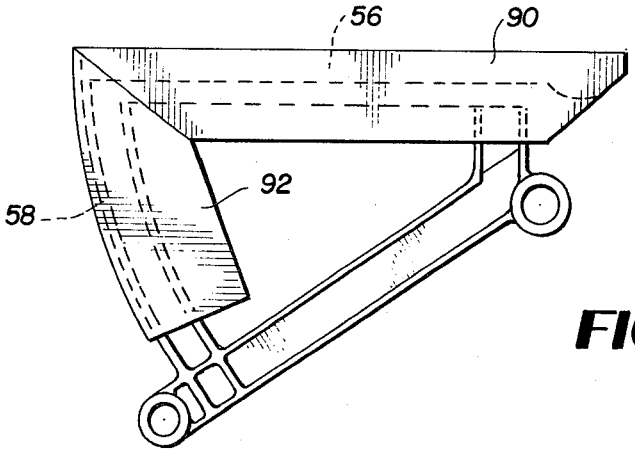
FIG. 11

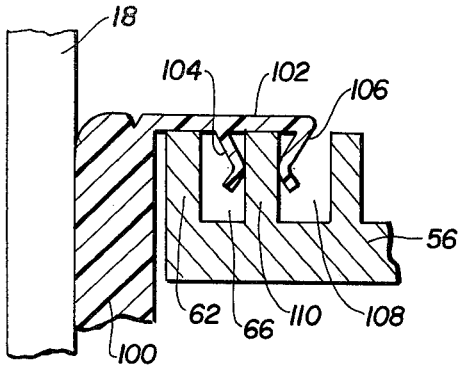
FIG.12
FIG.13
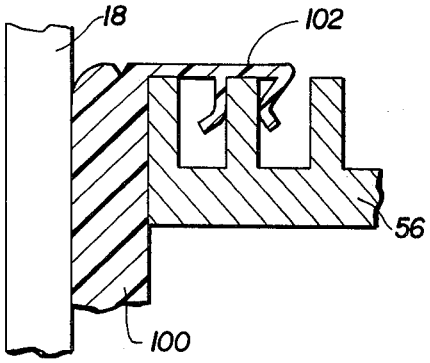
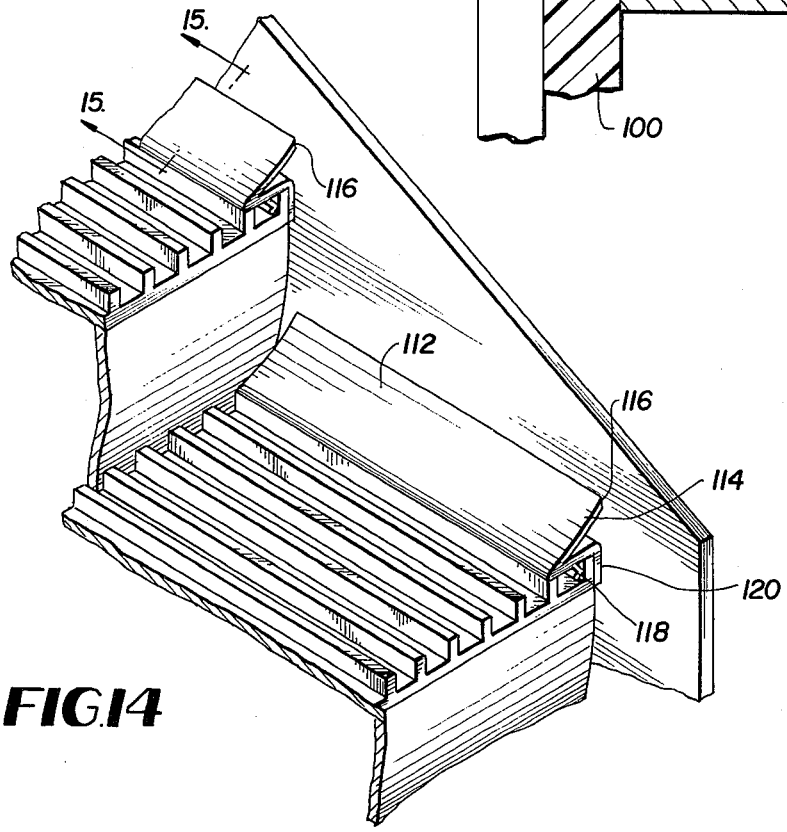
FIG.14

FIG.15
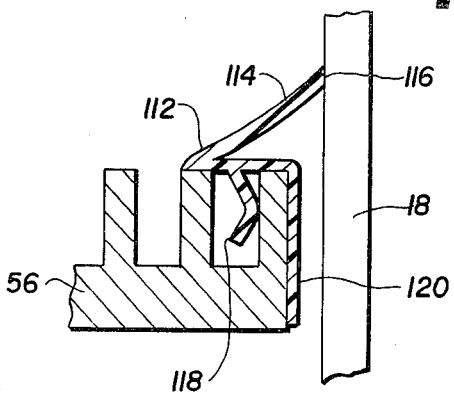
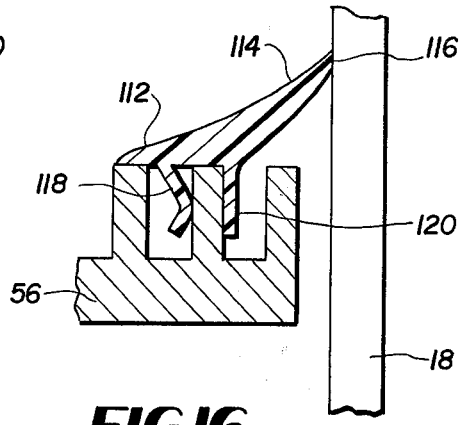
FIG.16
FIG.17
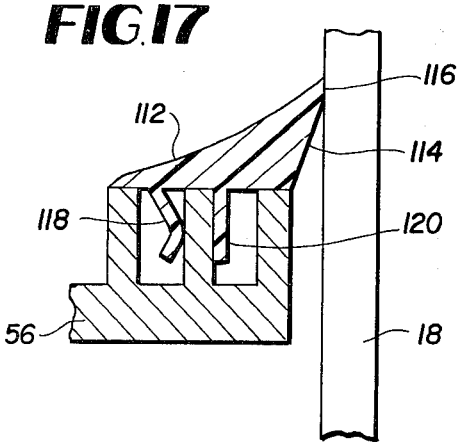
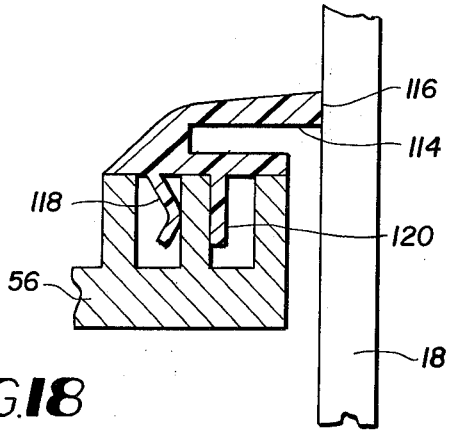
FIG.18

FIG.19
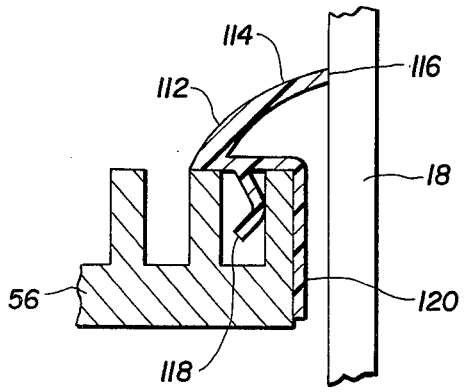
FIG.20
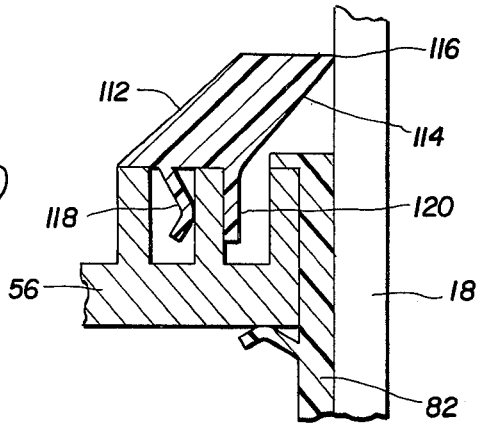
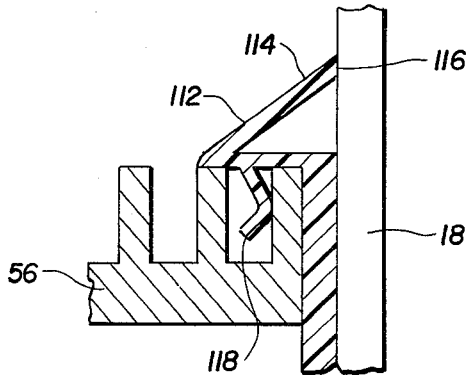
FIG.21

METHOD AND APPARATUS FOR ENTRAPMENT PREVENTION AND LATERAL GUIDANCE IN PASSENGER CONVEYOR SYSTEMS

BACKGROUND OF THE INVENTION

1. Field of the Invention

The invention relates generally to continuous passenger conveyor systems, such as escalators and moving walks, and, more particularly, to a method and apparatus for preventing passenger entrapment and providing lateral guidance to the moving assembly of the passenger conveyor.

2. Prior Art

Until the present invention, in all escalator systems, a running clearance gap has necessarily been provided between each of the lateral edges of the moving stairs and the adjacent, stationary, balustrade skirt panel in order to prevent the two from contacting each other. Consequently, various objects may intrude into this open gap and objects having a high coefficient of friction, e.g., passenger body extremities such as fingers and toes, or passenger apparel such as wet or dry-soled foortwear, rubber overshoes, sneakers, wellies or loose clothing, when placed in frictional contact with one of the skirt panels, may be drawn into this gap by the skirt panel and entrapped therein. Thus, such high frictional objects extending from the top tread surface of an upwardly moving escalator step against an adjacent, stationary skirt panel may be drawn by the skirt panel into this open gap and entrapped between the step and the skirt panel. Similarly, such objects extending from the generally vertical riser surface of a downwardly moving escalator step against an adjacent stationary skirt panel may be drawn into this gap and entrapped therein. When this entrapment occurs along the incline plane of the step travel, the pinching, drawing and knurling action, exerted on the object by the step side and the skirt panel, usually cuts and mutilates the object. When this entrapment occurs in the proximity of the escalator comb plate, even more serious consequences may result. For example, if the entrapped object is the toe of a small child's sneaker and the escalator is not stopped before the sneaker comes into contact with the comb plate, it is likely that both the sneaker toe and the child's toes enclosed therein will be amputated by the comb plate. Similarly, the entrapped fingers of a small child are usually amputated by the comb plate.

Because of the inherent danger involved in having an open gap between escalator stairs and adjacent skirt panels, since 1942 the American National Standard Safety Code for Elevators, Dumbwaiters, Escalators and Moving Walks, ANSI A17.1, has prescribed limitations for this running clearance gap. The 1942 supplement of this safety code added the requirement for newly installed escalators that the clearance on either side of the steps between the step tread and adjacent skirt panel not exceed 3/16 inch. This requirement was made more stringent in the 1955 edition of this safety code, which stated that the clearance on either side not exceed 3/16 inch, and that the sum of the clearances on both sides of the steps not exceed ¼ inch. This requirement was relaxed in the 1971 edition, which doubled the allowable running clearance on either side of the step treads and adjacent skirt panel from 3/16 inch to ⅜ inch, and deleted any reference to a limit of the sum of the clearances on both sides. This requirement was again made more stringent in a 1980 supplement to this code, which reinstated the original requirement that the clearance on either side of the step not exceed 3/16 inch. However, this 1980 code supplement did not reinstate the 1955 to 1971 code requirement that the sum of the clearances on both sides of the steps not exceed ¼ inch. Thus, the changes which have been made in the code requirements concerning the maximum width of this running clearance gap over the past 40 years indicates the difficulty of maintaining a narrow running clearance between the step tread and adjacent skirt panels.

Regardless of present or past code requirements. it is well known by escalator manufacturers, insurance companies, elevator consultants, and litigants to accidents that high frictional and flexible objects, such as soft-soled shoewear, fingers, toes, etc., can still be drawn into, and entrapped, in a relatively narrow gap.

Due to the constant eccentric loading imposed on an escalator stairway in operation, and the consequent wear on the bearings, the sides of the track system and the wheels running therein, the lateral movement of the steps increases. Thus, on an escalator which has been in use for a period of years, a person standing on one of the escalator steps can cause the step to shift ffrom one side to the other merely by shifting his weight sideways, thus increase the normal running clearance of that step on one side. For this reason, it is doubtful that most of the estimated 30,000 escalators in operation at the present time in the United States can meet any of the maximum running clearance requirements of the American National Standard Safety Code, enacted since 1942, if accurately measured.

Also, since at least 1974, the American National Standard Safety Code began to require a "skirt obstruction device" be furnished on all new escalators. This device is defined in the code as means to cause the opening of the power circuit to the escalator driving machine motor and brake should an object between the step and the skirt panel as a step approaches the lower comb plate. Since at least 1978, this requirement has been extended to apply also to the upper comb plate. Typically, this skirt obstruction device comprises four safety switches, or sets of switches, which are mounted in the skirt panels at theupper and lower end thereof, respectively, at various distances (unspecified by code) from the comb plate, usually no more than two feet. Flexible objects having a high coefficient of friction, such as footwear of rubber material or toe or fingers of a person, which becomes wedged between the edge of the moving step (generally cast aluminum) and the stationary skirt panel (typically stainless steel or procelain enamel) will continue to be entrapped along the travel of the escalator between the switches, until and if the safety switch at either the top or botton of the escalator is actuated by a force or pressure exerted on it by the trapped object. Some escalators, especially older models, have microswitches for stopping the escalator located behind the flexible skirt panels. In such escalators, an object trapped between the step side and the skirt panel must create sufficient force or pressure to deflect the skirt panel outwardly in order to operate the microswitch located behind it. Such deflectible skirt panels compound the danger of these exposed running clearance gaps by allowing the clearance gap to become greater after an object is trapped therein and thus allows a larger portion of the object to be drawn inward. For this reason, the Canadian Safety Code has required for many years that, on newly installed escalators, skirt panels shall not deflect more than 0.06 inch under a force of 150 pounds at any exposed point between the upper and lower comb plates.

Since 1980, the American National Standard Safety Code has required a deflection of not more than 1/16 inch under a force of 150 pounds at any exposed point between the upper and lower comb plates.

Skirt panels manufactured in the United States prior to this 1980 restriction are capable of deflecting variable amounts depending on such design factors as the gauge thickness and Brinell hardness of the sheet metal outer layer of the skirt panel, the reinforcement, such as formed metal, plywood, or chipped board, the spacing between reinforcements, etc.

In more recent years and currently, skirt safety switches are mounted behind the skirt panels but have operating heads or buttons which extend through openings in the skirt panels and which are intended to be directly activated by respective entrapped objects passing thereby.

Such skirt safety switches, when properly adjusted, should detect any entrapped object passing over them and actuate the drive machine brake to stop the escalator. However, these skirt safety switches can be operated unnecessarily by lateral shifting of a step of an older escalator caused by a passenger standing on the step suddenly shifting his weight. Thus, there always exists the danger that a service or maintenance mechanic, in adjusting the location of these switches away from the running step sides in order to prevent such unnecessary shut-downs, renders the switch relatively inoperative when an entrapped object passes through the switch area.

Obviously, a skirt safety switch only performs its designated function if it stops the escalator before the entrapped object actuating this safety switch enters the comb plate. However, the stopping rate or distance of an escalator, which has never been specified by the American National Standard Code or Canadian Standards Association Code, varies considerably with the number of people riding the escalator, the direction of the escalator speed, the spring tension on the brake, the size of the brake shoes, lubrication of moving parts and so forth. For example, a fully loaded escalator when traveling in an upward direction may be able to stop after traveling only six inches after the skirt safety switch was actuated, whereas the same fully loaded escalator when traveling in the downward direction may travel as much as six feet after the skirt safety switch is activated before stopping. When the escalator is traveling in an upward direction, the weight of the passengers being lifted adds to the stopping force of the brake whereas when the escalator is traveling in a downward direction, the passenger weight will drive the machine through the brake and the steps will drift further before coming to rest.

Also, since an escalator operates at an angle of no more than 30° from the horizontal in this country (and 35° in some other countries), during an emergency stop of the escalator, the escalator passengers are subjected to a forward force. Therefore, the maximum deceleration rate of the escalator, which occurs when the escalator is carrying a minimum number of passengers, must not exceed a rate of approximately one foot per second squared, in order to prevent throwing the passengers forward during the stopping operation. Thus, there is a greater danger that an escalator cannot be stopped by a skirt safety switch before the entrapped object reaches the escalator comb plate when the escalator is fully loaded and moving in a downward direction.

The majority of entrapment accidents occurring on escalators generally involve young children. Obviously, it is more difficult for a parent to observe and control his or her child while travelling on a fully loaded escalator rather than a lightly loaded one. Thus, on a heavily loaded downward moving escalator, the maximum difficulty in a parent overseeing a child coincides with the maximum danger of serious injury to the child should the child's sneaker or fingers become wedged between the moving stair side and the stationary skirt panel. For this reason, entrapment accidents regularly occur on even new escalators at museums, exhibits, amusements parks, etc., which are frequently crowded on weekends and holidays, at which times a high percentage of the escalator passengers are children.

Also, in order to reduce entrapment of objects within the exposed running clearance gaps between the moving steps and the stationary skirt panel, since 1971 the American National Standards Safety Code has required that the skirt panel adjacent to the step be of a material having a smooth surface, and that embossed, perforated or roughly texture materials shall not be used for these skirt panels. While this reduces the coefficient of friction between an object inserted into this gap and the skirt panel which exerts the force on this object to pull it into the gap, it does not prevent high frictional, pliable objects, such as the rubber toe or heels of sneakers or overshoes, or the fingers or hand of a child, from being pulled inwardly into this gap by the skirt panel during operation of the escalator.

In addition to the code requirements discussed above, various methods and devices have been proposed for reducing the likelihood of entrapping an object in the exposed running clearance space between a moving escalator step and the adjacent stationary skirt panel, and some of these have been adapted by escalator manufacturers and incorporated into their escalator systems. For example, the Hitachi Company of Japan uses longitudinally grooved escalator step treads in which several of the tread strips at both sides of the step adjacent the skirt panel extend upward approximately 8 mm above the remainder of the tread strips, which are of uniform height, so that when the passenger places his foot close to the edge, he will feel this difference in elevation and move his foot more to the center. This step plate construction is described in the German Pat. No. 2,161,442, published July 13, 1972. The Hitachi Company also provides yellow demarcation lines on all four sides of the step tread to thus delineate areas of this tread which should be avoided by the passengers. Unfortunately, the largest class of escalator entrapment accidents involve the young children, for whom the brightly colored raised tread strips adjacent the skirt panel may serve as an attraction, rather than as a deterent.

Also, on some of the escalators manufactured by the Hitachi Company, the surface of the skirt panel is coated with polytetra fluoroethylene low-friction fluorocarbon resin commercially available under the trademark "Teflon", to reduce the friction between the skirt panel and a shoe pressing contact against it, to thus minimize the possibility that the shoe will be drawn into the operating clearance gap between the moving stair and the stationary skirt panel. The chief disadvantage of such a Teflon-coated skirt panel is that Teflon is a relatively soft material. Thus, it is imperative the sides of the escalator steps, which are generally cast aluminum material of rough texture, not come into contact wih the Teflon-coated skirt panel. Also, objects having rough surfaces or sharp edges, such as delivery hand trucks, or baggage hand carts, generally used in transportation terminals must not come into contact with these Teflon-coated skirt panels. If such contacts did occur, the rough edges of the top and riser portions or the step of the steel tongs of a hand truck may scrape and gorge out portions of the Teflon coating, leaving a rough textured surface similar to that of a Teflon-coated frying pan which has been scraped and gouged. Such a rough textured skirt panel is not allowed by safety code requirements in this country, as discussed above. Thus, while the use of such Teflon-coated skirt panels would appear to be a desirable safety feature in new escalators, such coated panels could not be used on old escalators in which the steps can be shifted laterally by movement of the passengers on the escalator so as to rub against the skirt panels.

The benefits of using escalator skirt panels which are coated with a low friction material, such as Teflon, have been known for many years by escalator manufacturers in this country. For example, U.S. Pat. No. 3,144,118, insured Aug. 11, 1964 to Andrew Fabula, and assigned to Otis Elevator Company, describes such Teflon-coated escalator skirt panels and their advantages. However, the use of such Teflon-coated skirt panels has not been adapted by any major escalator manufacturer in this country, perhaps for the reasons discussed above. The skirt panels of all escalators manufactured in this country have a hard smooth surface, such as stainless steel or porcelain enamel, which is resistant to scratching and is easy to clean.

The Hitachi Company also recommends that an adhesion-preventing spray be applied to escalator panels to reduce friction between an object on the moving step which is pressed against the panel, as discussed above. However, to be effective, such a procedure requires constant, careful maintenance and, to a certain extent, well-mannered passengers. For example, children sometimes intentionally put their rubber soles on the tread or riser sides of escalator steps to rub them against the adjacent skirt panel to hear the screeching noise they create. If there is little or no noise, they exert more pressure to cause such noise, thereby removing the layer of wet lubricant. Even if such an action by a child does not result in his shoe becoming entrapped in the running clearance gap in the step and the skirt panel, it will have wiped away much of the lubricant, and thus reduce the protection against entrapment afforded by this lubricant to a subsequent passenger.

In many escalator locations, such as office buildings or department stores, cleaning personnel regularly (often nightly) apply spray cleaning agents and wipe down with rags, finger marks on balastrades and the scuff marks on skirt panels, thus removing adhesion-preventing sprays (usually applied by escalator maintenance mechanics) from the exposed portion of the skirt panel.

In other escalators locations, such as subway stations, or sport stadiums, where the escalator skirt panels are seldom cleaned, the wet adhesion-preventing spray applied to the skirt panels attracts dirt, dust and lint. Unless such panels are thoroughly cleaned and lubricant reapplied at regular intervals, such dirt and dust attracted to the lubricant can cause it to become gummy and sticky, causing the panel coefficient of friction to increase to a value greater than that of a bare, unlubricated panel.

Each escalator step is positioned and guided by a pair of step roller wheels, which are disposed on each side of the step for rotation about a horizontal axis, approximately 13 inches below the face of the step tread, and by a pair of chain wheels which are also disposed on each side of the step and which are rotatable about a horizontal axis of the step approximately 8 inches below the face of the step tread and approximately 4 inches outboard of the step edges. The step wheels and the chain wheels ride in two separate track systems. The chain wheels are incorporated in respective continuous step roller chains, which are engaged and driven by respective drive machine sprockets to move the escalator steps along a path of travel determined by the two track systems.

The step wheel and chain wheel tracks along the inclined portion of the step travel include bottom tracking surfaces over which the wheels roll, which determine the desired longitudinal and vertical movement of the steps, and vertically-extending side tracking surfaces which are spaced from the inner or outer sides of the wheels to provide sufficient clearance for the wheels to freely rotate without binding, and which thus determine the maximum lateral movement of the steps from a desired center line position. Thus, it is seen that some lateral movement of the stair must be allowed, even on newly installed escalators, to prevent binding of the step or chain wheels within their respective tracks. Therefrom, the skirt panel between which the steps run must be positioned so that the running clearance gap between each skirt panel and the sides of the steps is sufficient to allow for the side motion of the steps, so that the side of the moving step will not engage either skirt panel during operation of the escalator.

Thus, one way of reducing the possibility of objects getting caught between the sides of the steps and the skirt panels is to provide a lateral guidance system for the steps to reduce the side motion of the steps and thus reduce the operating clearance required between the stationary skirt panels and the moving steps. One such lateral guidance system for escalator steps is described in U.S. Pat. No. 2,813,613, issued Nov. 19, 1957 to S. G. Margles, and assigned to the Otis Elevator Company. In this system, each step includes two horizontally-extending castors typically fastened to the frame of each step, one on each side of the step. Each castor includes a hard rubber wheel which extends slightly beyond the edges of the step tread plate and riser, in rolling contact with the adjacent skirt panel. In this way, the two skirt panels serve as a guide track for the castor rollers of each step, to thus maintain a constant uniform clearance between each side of the step and the adjacent skirt panel throughout the step travel. In this system, the peripheral area of each castor wheel in contact with one of the skirt panels is relatively small; thus, the unit pressure applied to the castor wheel as a result of an eccentric load on the escalator step may be relatively high, causing rapid wear on the castor wheel and the wheel bearing. Also, since the axis of rotation of the castor is offset from the axis of rotation of the castor wheel, axial loads applied to the castor wheel produce an eccentric load on the castor shank bearing. Thus, in order to maintain this lateral guide system in good operating condition, it may be necessary to regularly replace not only the castor wheel, but also the castor wheel bearings and the castor shank bearings. This lateral guide system has never been used on production escalators manufactured in this country, perhaps because of the increased maintenance expense required.

In the escalator step described in U.S. Pat. No. 2,981,397, issued Apr. 25, 1961 to Hans E. Hansen, and assigned to Westinghouse Electric Corporation, the tread cleats immediately adjacent each stairway skirt panel are fabricated of resilient material such as rubber, having a higher coefficient of friction than that of a adjacent stairway parts, which are fabricated of a substantially non-resilient material such as aluminum. When an object such as a passenger's shoe comes into contact with the resilient cleat and the adjacent skirt panel, the force exerted on the top of the resilient cleat by this object will cause the cleat to move in a direction such that the gap between the flexible cleat and the adjacent skirt panel will be closed, thus preventing this object from being drawn into the gap by the skirt panel as the stairway moves in an upward direction. In order for this protective device to function properly, the force must be applied by the object to the top of the flexible tread before the object is drawn into this gap. Thus, this flexible cleat offers no protection to a youngster who presses the toe of his sneaker or his fingers against the skirt panel without contacting the flexible cleat. In such a case, his finger or toe may be drawn into this gap by the skirt panel before any pressure is applied to the top of the flexible cleat. In such a case, the use of such a flexible cleat can increase the danger to the child, since the trapped finger or toe will exert a force on the side of the flexible cleat to deflect this cleat inwardly and widen the gap. It is perhaps for this reason that this flexible cleat arrangement has been seldom, if ever, used on commercial escalators in this country.

U.S. Pat. No. 3,986,595, issued Oct. 19, 1976, to Asano et al, and assigned to the Mitsubishi Company of Japan, describes a safety device, which is disposed at either the tread or riser edges of a step adjacent one of the skirt panels, for reducing the gap between the escalator step and the skirt panel after an object has become entrapped there between, at a point inward of the entrapped object, to thus prevent the object from being pulled inwardly by the skirt panel beyond this point at which the gap has been narrowed. On upward moving escalators, the device includes a sensor element and a displacement element which are mounted to, and extend along the side of the step tread. The sensor element is slidably mounted to the step so that it is vertically displacable relative to the step. The top side of the sensor element serves as the outermost cleat of the step tread, and is normally higher than the fixed cleats of the step tread. The sensor element has a lower beveled edge which is tapered inwardly and rests against a complimentary, outwardly-tapered, beveled edge of a displacement element, which is coextensive with the sensor element along the side of the step tread. The displacement element is pivotally attached to the step at its lower portion, and is resiliently biased so that normally the flat outer surfaces of the sensor element and the displacement element are coplanar and parallel to the adjacent skirt panel, to thus define a uniform gap between the step and the skirt panel. When an object such as the toe of a sneaker or the finger of a child is pressed against the skirt panel during upward movement of the escalator steps and is drawn by the skirt panel into the gap between the sensor element and the skirt panel, the force applied by the object on the sensor element causes the sensor element to be displaced downwardly. This downward displacement of the sensor element causes the upper beveled side of the displacement element to rotate outwardly, reducing the gap between the displacement element and the skirt panel and preventing the entrapped object from being drawn between the displacement element and the skirt panel. On downward moving escalators, the sensor element and displacement element can be disposed along the riser side of the step to limit the entrapment of any object which is drawn by the skirt panel into the gap between the sensor element defining the edge of the step riser and the skirt panel.

One disadvantage of these two safety devices is that they are mutually exclusive devices, that is, only one or the other of these two devices can be used on any one escalator step. Thus, on an escalator equipped with one or the other of these devices, the devices perform their intended safety function when the escalator is moved in one direction, but are ineffective when the escalator is moved in the opposite direction. Also, for certain objects, these devices could operate to increase the difficulty of disengaging the object. For example, if a woman trips or faints and her hair is drawn into the gap between the displacement element and the skirt panel before the sensor element has be displaced downward, the subsequent displacement of this sensor element by the woman's head, which is pulled downward by the entrapped hair against the sensor element, and the resulting outward movement of the displacement element, may prevent, or at least make more difficult, the release of the entrapped hair.

U.S. Pat. No. 4,236,623, issued Dec. 2, 1980, to Duane B. Ackert, discloses inclined guide strips which are mounted to the two sides of an escalator step tread, respectively. Each guide strip extends the full longitudinal length of the step tread. Each guide strip has a flat top portion and a beveled ramp portion which slopes upwardly and laterally outwardly from the extreme inner edge of the guide strip to the top flat surface. Each guide strip is fabricated of a material such as urethane which is relatively smooth and slippery for minimum friction, has a minimum tendency to adhere soft, hot and sticky articles, and is somewhat brittle so that it will readily break in the event of a jam. The inclined portion of each guide strip functions to guide articles that are close to the edge of the step tread away from such edge. The low coefficient of friction of the guide strip material and the slope or inclination of its ramp portion creates a tendency for such articles to slide downwardly away from the edge of the step. The vertical outer side wall of each guide strip extends outwardly beyond the side of the step to which it is mounted, so that the width of the running clearance gap between the two stationary strip panels and respective sides of the moving step is determined by the two guide strips. If the lateral displacement of the step increases due to wear of various moving elements of the escalator, so that the outer side wall of the guide strip comes into contact with the adjacent strip panel, the softness of the guide strip material prevents any scratching of the skirt panel. However, when the various elements of escalator become worn enough so that the sudden shift of a passenger standing on the step causes a sudden lateral movement of the step, the fact that the material of the guide strip is somewhat brittle can be disadvantageous, in that the strip may break when the step is abruptly shifted against the adjacent skirt panel. Also, since the preferred height of the outer side wall of the guide strip is only about $\frac{1}{4}$"

so that if the step is eccentrically loaded so as to hold the outer side wall of the guide strip in contact with the skirt panel, the pressure per unit area may be relatively high, resulting in rapid wear of the outer side wall of the guide strip and thus causing an increase in the normal running clearance gap determined by this outer side wall.

The above-described known methods and devices for minimizing the occurrence of entrapment accidents on escalators all presume that it is necessary to prevent contact between the two stationary skirt panels and the escalator steps moving therebetween, and therefore, that a running clearance gap between each moving step side and the adjacent stationary skirt panel is a necessary, albeit undesirable, feature of all escalators. Thus, it would be highly desirable if new escalators could be designed, and existing operating escalators modified, so that not only would contact between the skirt panels and the escalator steps be non-harmful, but also that such contact would contribute to the smooth operation of the escalator and reduce wear and consequent maintenance on other elements of the escalator. In such a case, a minimum running clearance gap between each moving step side and the adjacent stationary skirt panel would not only be unnecessary, but also undesirable. Thus, this gap, and the danger of entrapment posed by this gap, could be eliminated.

OBJECTS AND SUMMARY OF THE INVENTION

Therefore, it is a primary object of the invention to provide a method and apparatus for minimizing or eliminating the gap between the moving assembly of either a new or existing operating passenger conveyor, such as the steps of an escalator or the treadway of a moving walk, and adjacent stationary balustrade skirt panels.

It is a related object of the invention to provide a method and apparatus for providing lateral guidance to the moving assembly of a passenger conveyor.

It is a further object of the invention to provide a method and apparatus for reducing friction between the moving assembly of a passenger conveyor and adjacent balustrade skirt panels in moving contact therewith.

It is another object of the invention to provide a method and apparatus for preventing a "wringer" action on an object, such as a child's sneaker or hand, inserted into the gap between the moving stair of an escalator and adjacent stationary skirt panel so as to roll or curl the object about the side of the moving stair.

It is still another object of the invention to provide a method and apparatus for reducing friction between a stationary skirt panel and an object wedged between the stationary skirt panel and an adjacent side of the moving assembly of a passenger conveyor, and also reducing friction between the object and the side of the moving assembly, so that the object can be easily withdrawn and freed without injury.

It is a still further object of the invention to provide visual and/or tactile indication to escalator passengers of areas of the step tread and riser surfaces adjacent each stationary skirt panel which should be avoided by the passengers.

It is another and further object of the invention to provide a method and apparatus for closing any gap between the stationary skirt panel and an adjacent edge of an escalator step directly beneath the foot of a passenger standing on this step edge.

In a first embodiment of the invention, step bearing plates of long wearing, low friction, self-lubricating, resilient plastic material are mounted on escalator step sides, and the escalator skirt panels are adjusted inwardly to minimize the running clearing gap between the skirt panels and the stairs. The bearing plates and skirt panels serve as an additional lateral guidance system for the escalator steps, to thus reduce wear, noise, and vibration during operation of the escalator. Further, by reducing the gap between the skirt panels and the bearing plates to a minimum, the likelihood of entrapping an object within this gap is also reduced to a minimum. The step bearing plate extends at least several inches inwardly from the outer step tread and riser surfaces to prevent any object entrapped therebetween from being curled around the step tread or riser and drawn into the open space within the step. Also, since both the skirt panel and the bearing plates have smooth surfaces, any object entrapped therebetween can be easily withdrawn with minimum damage to it. Further, the step bearing plates can be brightly colored to serve as a passenger warning strip.

As the step bearing plates wear, the skirt panels can be periodically adjusted inwardly to maintain a minimum running clearance gap. Also, the step bearing plates may be slidably mounted to the step sides for limited lateral movement, and a biasing means, such as one or more springs, may be used to exert an outward force on these step bearing plates which is sufficient to maintain these bearing plates against the adjacent skirt panel, up to the maximum limit of their lateral path of travel, after which the skirt panels can be adjusted inwardly to position the step bearing plates at their minimum, inward position. In such an arrangement, the running clearance gap between skirt panels and the bearing plates is automatically maintained at its minimum value.

When these step bearing plates are retrofitted to the steps of an escalator that is already installed and operating, the escalator skirt panels can be preconditioned by disposing a set of plates or blocks of low friction plastic material on opposite sides of one of the steps, applying a biasing force to hold these plastic blocks or plates firmly against the two skirt panels, and running the escalator up and down to continuously move these plastic blocks back and forth over the outer surfaces of the skirt panels, to thus impregnate microscopic voids and irregularities in the skirt panel surfaces with this low friction plastic material.

In another embodiment of the invention, raised "curb" members which are affixed to the escalator step sides, extend upwardly and outwardly against the adjacent skirt panel to close the running clearance gap therebetween. The curb members are shaped so that if a passenger steps upon this curb member, the outer edge of the curb member is moved outward and downward into firm contact with the portion of the skirt panel adjacent to the foot of the passenger. These curb members may be used in conjunction with step bearing plates, and may also be brightly colored to serve as passenger warning strips.

The invention will be better understood, as well as further objects and advantages thereof will become more apparent from the insuing detailed description of preferred embodiments, taken in conjunction with the drawings.

BRIEF DESCRIPTION OF THE DRAWINGS

FIG. 5 is a fragmentary cross-sectional view of the embodiment in FIG. 4, taken along the line 5—5 of FIG. 4.

FIG. 8 is a fragmentary cross-sectional view of the embodiment shown in FIG. 7, taken along the lines 8—8 of FIG. 7.

FIGS. 9 and 10 are fragmentary cross-sectional views of two modifications of the embodiment shown in FIG. 7, taken along the lines 9—9 of FIG. 7.

FIG. 11 is a side-view of an escalator step showing a third variation of the first embodiment.

FIGS. 12 and 13 are fragmentary cross-sectional views of a fourth variation of the first embodiment, shown in alternate, limiting positions.

FIG. 14 is a perspective partial view of one side of an escalator, showing a second embodiment of the invention.

FIGS. 15–19 shows cross-sectional views of different variations of the embodiment of FIG. 14, taken along the line 13—13 of FIG. 12.

FIG. 20 is a cross-sectional view of the embodiment of FIG. 14, together with a fragmentary cross-sectional view of the first embodiment of the invention.

FIG. 21 is a fragmentary cross-sectional view of a third embodiment of the invention.

DESCRIPTION OF PREFERRED EMBODIMENTS

Figure 1:
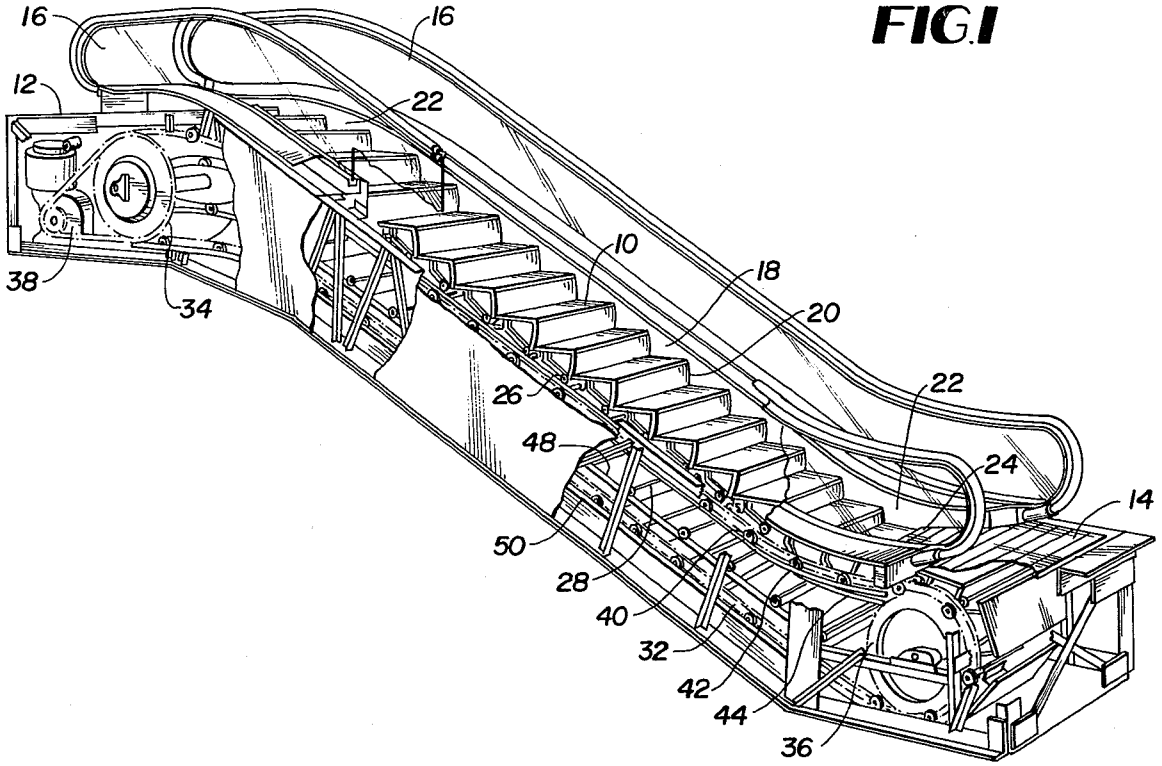
FIG. 1 is a simplified perspective view of an escalator using the present invention.
Figure 2:
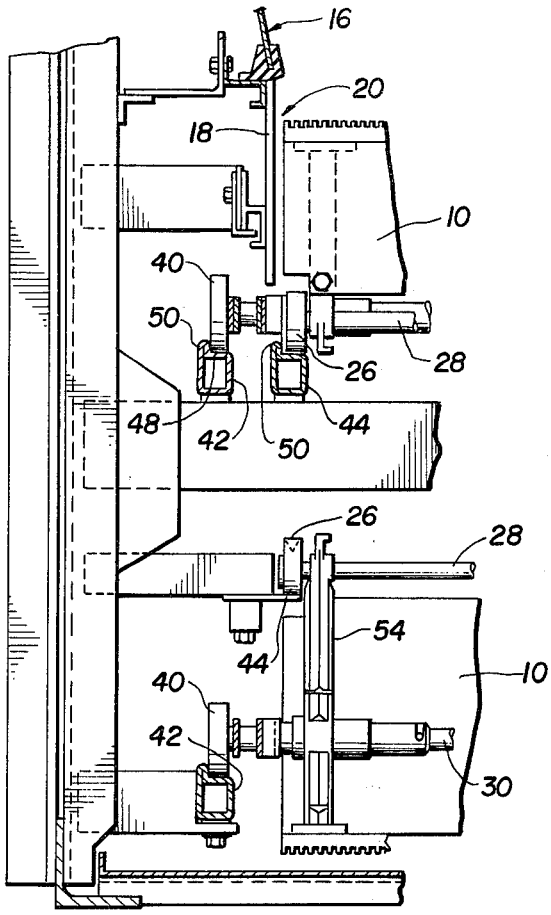
FIG. 2 is a simplified fragmentary cross-sectional view taken along the long 2—2 of FIG. 1.
Figure 3:
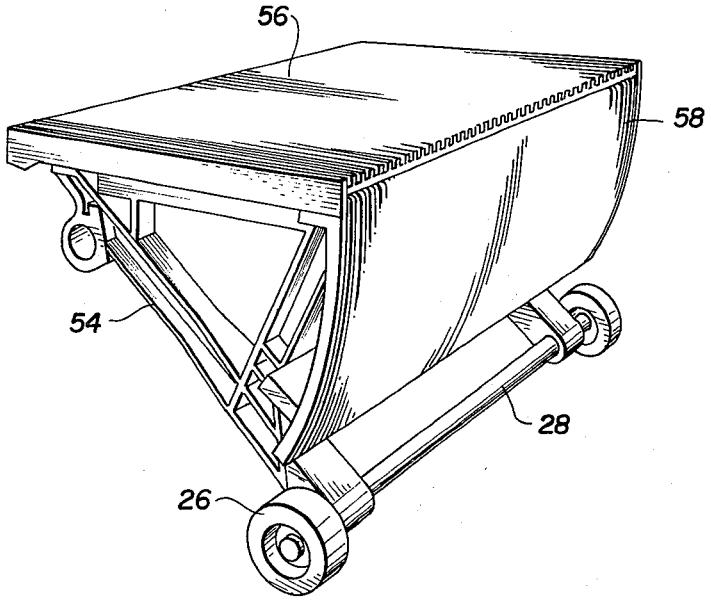
FIG. 3 is a perspective view of one of the steps of the escalator shown in FIG. 1.

Referring now to FIGS. 1–3, escalators include an endless series of steps 10, which may be moved in either direction between a top landing 12 and a bottom landing 14. Two balustrades 16, on either side of the escalator steps 10, each include a vertically disposed, laterally adjustable, skirt panel 18 adjacent one side of the steps 10. These skirt panels 18 are adjusted laterally to determine the width of the running clearance gap 20 between the side of the steps 10 and the skirt panel 18. Typically, the skirt panels 18 are rigid, substantially non-deflecting, panels having a hard, smooth outer surface, such as stainless steel or porcelain enamel. In escalators of recent manufacture, each skirt panel 18 is associated with at least two skirt guard safety switches 22 which extend through respective openings in the skirt panel 18 near the top and bottom ends thereof to detect objects entrapped between the side of the escalator step and the skirt panel and thereafter deactivate the escalator drive machine and activate the brake. However, as discussed earlier, some existing operating escalators include skirt safty switches 22 which are amounted behind flexible skirt panels 18, each of which must be deflected outwardly by an object trapped between the side of an escalator step 10 and the skirt panel 18 in order to operate the skirt safety switch 22 located behind it.

Each escalator step 10 includes two step roller wheels 26, which are rotatably mounted to a laterally extending axle 28 of the step 10. Typically, the step roller wheels 26 include a tire of resilient material, such as polyurethane, affixed to an aluminum hub which is rotatably mounted to the axle 28 by sealed ball bearings. The step 10 also includes another laterally-extending axle 30, which is rotatably attached to two step roller chains 32 disposed on opposite sides of the steps 10. At the top and bottom of the escalator, each roller chain 32 is engaged by a driver sprocket 34 and an idler sprocket 36, respectively. The two roller chains 32 are driven about their respective driver sprockets 34 by a driving machine 38, to move the steps 10 either in an upward or a downward direction, as selected by a keyed switch.

Each escalator step 10 also includes two chain wheels 40, which are rotatably disposed on the step axle 30 on opposite sides of the step 10, and which may be similar in construction to the step wheel 26. The step wheels 26 and the chain wheels 40 ride in two separate track systems. Changes in the vertical height between the chain wheel track 42 and the step wheel track 44 cause the steps 10 to flatten out at both the upper and lower ends of the escalator. Each track system is curved at the upper and lower ends of the escalator where the steps 10 and their connecting wheels 26, 40 rotate about the axis of the driver sprocket 34 or idler sprocket 36 and return in an inverted position to the other end of the escalator where they are again rotated 180° to their normal position. The chain wheel tracks 42 and the step wheel tracks 44 along the inclined portion of the path of travel are usually made of rolled steel sections having burnished tracking surfaces 48, 50 to guide the face and one side of the wheels 26, 40. The curved or circular portions of these tracks 42, 44 at the upper and lower sections of the escalator where the steps 10 reverse their travel, are usually made of machined cast steel. The desired longitudinal and vertical movement of the steps 10 are determined by the bottom tracking surfaces 48 of the chain wheel track 42 and the step wheel track 44 in rolling contact with the chain wheel 40 and the step wheel 26, respectively. The lateral position of the steps 10 are determined by the generally vertically extending tracking surfaces 50 of the chain wheel track 42 and the step wheel 44 adjacent the sides of the chain wheel 40 and the step wheel 26.

The escalator steps 10, and consequently the step wheels 26, 40 and the roller chains 32 are subjected to constantly changing eccentric loads caused by passengers stepping onto or off one side of an escalator step 10, moving from side to side on the step, or walking up or down the steps. These constantly accurring eccentric loads produce wear on the wheel bearings and axles of the steps, the wheel face and tracking sides, the wheel tracks, and the pins and links of the roller chains 32. When an escalator is first installed, the portions of the roller chains 32 between the steps 10 are of uniform length to keep each step 10 running properly within the tracks 42, 44. However, eccentric escalator loading may cause more wear on the pins and links of one roller chain 32 than on the other roller chain 32. In such a case, some of the steps 10 may become "cocked" so that the step wheels 26 on one side of the stairs and chain wheel 40 on the other side of the stairs continually rub against the side tracking surface 50 of the tracks 44, 42, respectively, creating noise and vibration and causing increased wear on these wheel and track surfaces, which in turn increases the lateral movement of the stairs 10 during operation of the escalator. In time, this lateral movement of the steps 10 increases to the point that these steps 10 have so much lateral play that they can be shifted laterally to rub against one or both of the skirt panels 18. When this occurs, it is necessary to space the skirt panels 18 further apart, thus increasing the running clearance gaps 20 between the skirt panels 18 and the steps 10.

Each step 10 of most escalators currently in use and all new escalators manufactured in this country include two open brackets 54 on either side of the step, to which the step axles 28, 30, are affixed. The step tread 56 is affixed to the top side of these brackets 54 and the step riser 58 is affixed to the top sides of these brackets 54, and the curved step riser 58 is affixed to the front sides of these brackets 54. Typically, the sides of the step tread 56 adjacent the skirt panels 18 do not exceed approximately one inch in thickness, and the sides of the step riser 58 adjacent the skirt panels 18 do not exceed ½ inch thickness. Thus, the frictional resistance provided by a tread or riser side to an object being pulled into the gap 20 by one of the skirt panels 18 is limited by its relatively small thickness. When an object is drawn by the skirt panel 18 into the gap 20, the resistance provided to the object by the tread or riser side will only increase, as the object is moved inwardly, until the object moves past the tread or riser into the open space within the step 10. When this occurs, a "wringer" action occurs, with the entrapped hand and/or soft footwear being curled around and under the sharp, die cast aluminum tread or riser side of the step by the skirt panel 18. This wringer action can be prevented by increasing the thickness of the lateral sides of the step tread riser. For example, each step support bracket 54 can be designed to include a lateral planar surface having a top and front portion of its periphery contacting the inner edges of the tread and riser of the lateral sides, with the adjoining lateral sides of the bracket 54, the tread 56, and the riser 58 being disposed in a common vertical plane. Alternately, a flat plate can be disposed between the step and tread lateral sides to increase the thickness of the step lateral edges to at least several inches.

In a first embodiment of the invention, an approximately triangular plate, having a flat top edge and a curved front edge approximately the same size as the tread and riser edges of the step 10, is affixed to both sides of the step 10 to enclose the open spaces beneath the steps and thus prevent the "wringer" action on an entrapped object described above.

Further, on escalators in which the skirt panels 18 not only have smooth, flat outer surfaces, but also are non-deflectible plates, these step side plates can be fabricated of a tough, non-stick, plastic material having a very low coefficient of friction, such as polytetraflouroethylene and the skirt panels 18 can be moved laterally inward so that these step side plates serve as bearing plates in sliding contact with the skirt panels 18. In such an arrangement, lateral shifting of the steps 10 is virtually eliminated, resulting in a smoother, quieter ride and reducing the possibility of passenger falls caused by the sudden lateral movement of the steps 10. Also, the gap 20 between the step side plate and the adjacent skirt panel 18 is virtually eliminated, thus greatly reducing the possibility of entrapping an object therebetween. The operating life of these step bearing plates, which are only subjected to intermittent eccentric loads at low speeds (90 fpm or 120 fpm) during less than half of the total step travel, should be several times that of the step roller and chain wheels 26, 40, which must continuously support the weight of the steps and any passengers thereon during almost all of the total step travel. Further, the contact area of each step bearing plate is large relative to the contact area of the step wheels 26, 40, and thus the force per unit area applied to the step bearing plates is much smaller than the force per unit area applied to the step wheels 26, 40. Also, the life of the step wheels 25, 40 should be greatly extended by the lateral guidance provided by the step bearing plates.

Escalator manufacturers can redesign the step support brackets 54 so that these step bearing plates can be easily and quickly installed or removed from the steps.

On future escalators, the step support brackets 54 can be designed so that these bearing plates can be easily installed or removed from the steps. However, a step bearing plate that could be easily and quickly installed on most of the estimated 30,000 escalators currently in operation in this country and the many thousands of others throughout the world would be highly desirable.

Figure 4:
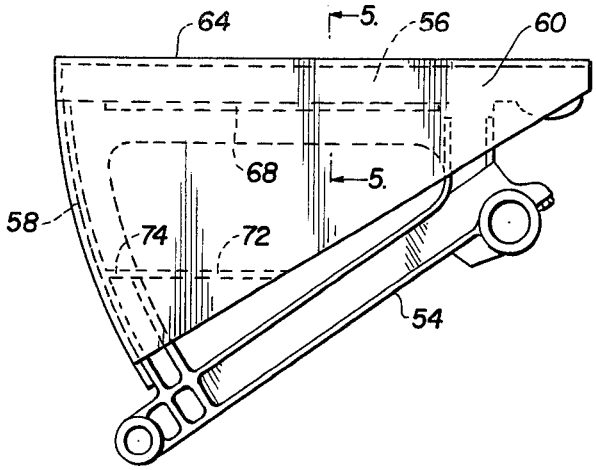
FIG. 4 is a side view of the escalator step shown in FIG. 3, showing the first embodiment of the invention.

One such step bearing plate, which can be easily and quickly installed or removed from most of the esclators currently in use in this and other countries is shown in FIG. 4. In order to insure that most of the escalators presently in use are retrofitted with these step bearing plates, it is desirable to minimize the cost of fabricating these plates as well as the cost of installing or replacing them, so that escalator owners will consider the use of these step bearing plates to be a good business investment for the protection of the riding public and to reduce insurance liability premiums, personal injury defense suits, judgments and settlements. For this reason, these plates are inexpensively formed as a continuous extrusion, which can be easily stamped or cut to form a step bearing plate 60 for use on a particular model escalator of most of the escalators presently being operated.

On most escalators, each support bracket 54 is spaced inwardly by about an inch or so from the lateral sides of the step tread 56 and step riser 58. Also, the American National Standard Safety Code requires that the tread surface of each step be slotted in a direction parallel to the travel of the steps, with the distance between slot center lines not exceeding ⅜ inches, and with each slot not exceeding ¼ inch in width and having a minimum depth of ⅜ inches. Because of these code requirements, most escalator step treads 56 include end riser cleats 62 having a width of approximately ⅛ inch. Thus, the top of the step bearing plate 60 is formed as a standard plate clamping end 64 which is suitable for clamping onto the end of a flat plate having a thickness in the range of 3/32 inch to 3/16 inch, and which does not extend more than ⅜ inch into the slot 66 adjacent the end riser cleat 62, as shown in FIG. 4.

Objects in contact with one of the skirt panels 18 are only drawn into the gap 20 between a step riser 58 and the skirt panel 18 on a descending escalator. Since, in such a case, the skirt panel 18 moves the object in contact with it in an upward direction as well as a backward direction relative to the decending steps 10, and since the rise between adjacent step treads 56 is limited by code to no more than 8 ½ inches, the maximum height of each step bearing plates 60 does not need to exceeed 8 ½ inches.

The side edge of the step tread 56 varies from a minimum of about ½ inch to a maximum of about 1 1/16 inch, depending on the model and manufacturer of the escalator. However, even on the escalator steps having the thickest step tread sides, the thickness of the step tread 56 inwardly from the edge is much smaller, typically about ½ inch. Thus, the step bearing plate 60 includes a clamping extension 68 which is designed to either grip an edge flange 70 of approximately ⅛ inch thickness on a step tread 56 having such an edge flange, or to grip the bottom of a step tread 56 which has a thickness in the range of ½–¾ inches and which does not include an edge flange. When the step tread 56 also includes laterally extending support flanges, the clamp extension 68 can be slotted to accommodate such support members. Such slots also serve to prevent any forward movement of the step bearing plate 60 relative to the step when the escalator is moving in an upward direction. On step treads 56 having a thickness greater than ¾ inch, the end of the plate clamping extension 68 can be cut off, as required, to thus accommodate any step tread 56 up to a tread thickness of 1/16 inch.

The step bearing plate 60 may also include a horizontally extending rib 72, having a front surface 74 disposed against the inside of the step riser 58, to prevent forward movement of the bearing plate 60 with respect to the step 10 on which it is mounted. Also, the rib 72 may extend into, and be gripped by, a steel spring clip 76 or the like, which is mounted to a side of the step support bracket 54. In this way, the step bearing plate 60 is secured to the step at both its bottom and top sides.

Figure 6:
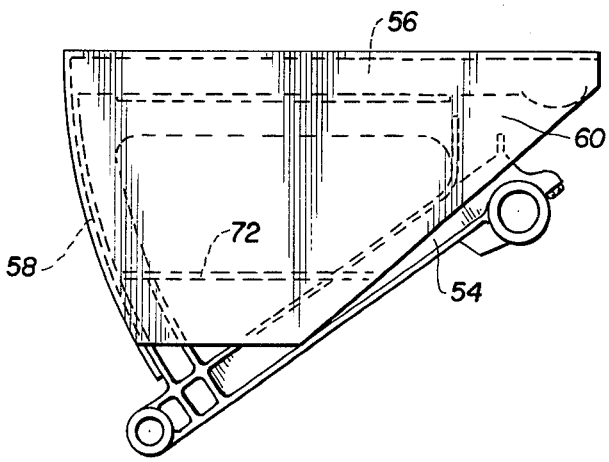
FIG. 6 is a side view of an escalator step showing a first variation of the embodiment of FIG. 4.

If desired, the bottom side of the step bearing plate 60 can be extended so that it overlaps the diagonally extending portion of the support frame 54, and the length of the rib 72 can be selected so that this rib extends to the diagonal portion of the support bracket 54 which is furthest disposed from the step edge, as shown in FIG. 6. For steps having their support brackets disposed closer to the step edge, the rib 72 can be notched so that it is properly positioned against the support bracket. In this way, the step bearing plate 60 is supported and properly spaced by the support frame 54 as well as by the edges of the step tread 56 and step riser 58. If desired, the plate rib 72 can also be secured within and held by another spring steel clip 76 mounted on the diagonal portion of the support bracket 54.

Preferably, the thickness of the step bearing plate 60 is much greater than that required for successful operation, so that these bearing plates 60 will have an exceptionally long operating life and will seldom have to be replaced. For example, the skirt panels 18 of most escalators are sufficient adjustable to allow the use of ⅜ inch thick step bearing plates 60. In such a case, during the operation of the escalator and the consequent wear on the bearing plate 60, the skirt panels can be periodically adjusted to close any gap 20 between the skirt panels 18 and the step bearing plates 60 resulting from such wear. When the bearing plates 60 have eventually worn to a minimum thickness considered necessary for proper operation, for example, 1/16" inch, which can be indicated by a line or notch 80 on the exposed top and front edges of the bearing plates 60, these plates 60 can be easily replaced with new ones. The use of relatively thick bearing plates 60 is also advantageous when a brightly colored plastic material is used to form these plates so that their edges serve as passenger warning or guidance devices.

Before retrofitting the steps of an operating escalator with the step bearing plates 60, the skirt panels 18 of the escalator must be adjusted away from the steps 10 in order to provide sufficient clearance for the bearing plates 60. Also, the operating heads of the skirt guard safety switches 22 must be adjusted or replaced so that these heads are flush with the bearing surface of the skirt panels 18. The end tooth on both sides of the top and bottom comb plates 24 should be removed, since the end slot 66 into which these end teeth of the comb plates 24 normally extend, will be covered by the clamping extension 64 on the bearing plates 60. Also, the clearance beneath these end portions of the comb plates 24 and the landing plates to which they are attached should be checked, and if necessary increased, to be sure that the top end of the bearing plates and landing plates 60 clear these ends of the comb plates 24 and landing plates.

After a set of bearing plates 60 have been installed on each escalator step 10, the skirt panels 18 should be adjusted inwardly so that there is virtually no clearance between the skirt panels and the adjacent bearing plates 60. Generally, the skirt panels 18 are made up of a plurality of skirt plate segments having a length in the order of 6–10 feet.

The end edges of these skirt plate segments are generally manufactured smoothly, rounded or beveled, but should be checked and refinished if necessary so that if one of these segments becomes slightly out of line during operation of the escalator, this edge will not cut into the bearing plates 60. Also, all of the outer edges 82 of the bearing plates 60 should be rounded or beveled, so that these plates can ride up on and over such misaligned joints in the skirt panel. Further, each skirt panel 18 should have a rounded or tapered entrance portion at both ends to smoothly guide the bearing plates 60 as they enter into contact with the skirt panels 18. When the skirt panels 18 are adjusted inwardly against the bearing plates 60, care should be taken so that each skirt panel segment is aligned with adjacent segments, and/or skirt panel entrance portions, for the reasons stated above. The first wearing on the step bearing plates 60 can be expected to be somewhat greater than the normal wear on these plates after these plates and the skirt panels have been smoothed and aligned by the initial "self-machining" interaction between the skirt panels and bearing plates.

Depending on the type of material used for the step bearing plates 60, during the break-in period after initial installation of these plates, the skirt panels 18 can be sprayed with an adhesion-preventing coating to reduce wear during this break-in period. After the bearing surfaces have become fully seated and aligned, the bearing plates 60 and the skirt panels 18 can be thoroughly cleaned to remove this coating, to thus minimize subsequent maintenance on the escalator. As discussed above, the continuous use of such liquid lubricants on these bearing surfaces is only beneficial if these bearing surfaces are thoroughly and frequently cleaned to remove this coating along with dirt and dust entrapped in it, and a new coating applied.

Also, prior to installing these step bearing plates 60, the skirt panels 18 can be preconditioned by microscopically impregnating the bearing surface of these skirt panels 18 with a plastic material having a low coefficient of friction when placed in sliding contact with the bearing plates 60. Depending on the type of material used for the bearing plates 60, the plastic impregnating material for the skirt panels 18 may be the same, or a different material than that of the bearing plates 60. In one method of so impregnating the skirt panels 18, two plates or blocks of the impregnating material can be disposed on either side of one escalator step 10, and spring-loaded so that these plates or blocks are firmly held against the skirt panels 18. The escalator can then be run up and down so that surface portions of these plastic blocks or plates are frictionally heated to its melting point, to thus fill microscopic voids and surface irregularities of the skirt panels 18.

The material selected for the step bearing plates 60 should be a resilient, tough, plastic material having a low running or dynamic, coefficient of friction and a high resistance to abrasion. Such properties are readily available in plastic materials which have been commonly used for years in heavy industrial applications under more demanding conditions than can be anticipated by their application to escalators and moving walks as envisioned by this invention. For example, bearing plates of polytetraflouroethylene (TFE), which not only has an exceptionally low dynamic coefficient of friction of 0.04–0.2 (dry vs. steel) but also has exceptional non-stick characteristics, can be used with any skirt panels having hard smooth surfaces. Also, various mixtures of TFE and other materials may be used. For example, one such material, which is sold commercially under the trademark Flourosint by the Polymer Corporation, Reading, Pa., and which is composed of TFE to which a synthetic mica filler has been added for better wear resistance, also has a low dynamic coefficient of friction in the range of 0.04–0.2. Also, various combinations of acetal resin and TFE florocarbon fibers which are sold commercially under the trademark Delrin by the Du Pont Corporation, and which have coefficients of friction within the range of 0.05–0.3, depending on the particular type of Delrin, may also be used for the step bearing plates 60 in many applications, especially when the bearing surfaces of the skirt panels 18 are stainless steel. Also certain nylon compounds having good wear resistance as well as low friction characteristics, such as self lubricating, graphite-impregnated nylon compounds may be used for these bearing plates in some applications. For example, a mixture of nylon and solid lubricants and other additives which is sold commercially under the trademark Nylatron NSB by the Polymer Corporation, has good wear resistance and a coefficient of friction in the range of 0.13–0.18. Also, low friction plastic materials which are relatively inexpensive in comparison to TFE compounds but which have lower resistance to abrasion, for example high molecular weight polythelene which has a coefficient of friction of 0.09–0.12, could be used for some applications. However, the use of such material for the step bearing plates 60 would require more frequent adjustment of the skirt panels 18 and replacement of the plates 60.

Figure 7:
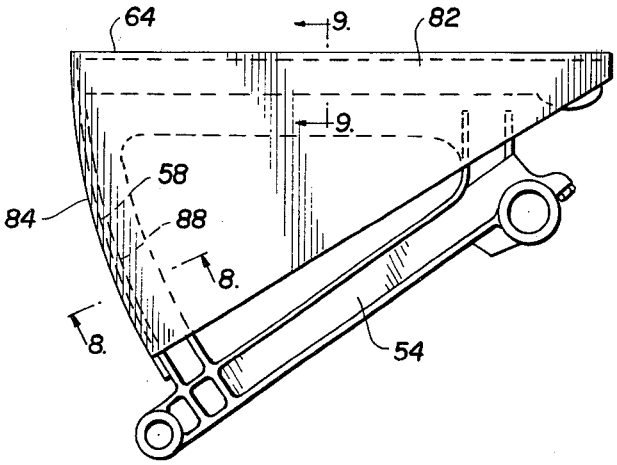
FIG. 7 is a side view of a second variation of the first embodiment of the invention.

FIGS. 7 and 8 of the drawings show a molded step bearing plate 82 which is similar to the step bearing plate 60 in that it includes the top plate clamping end 64, described above, and the clamping extension 68, also described above, which can be cut to fit the particular step tread, depending on the thickness of this tread. In addition, the step bearing plate 82 includes a curved front portion 84 which extends laterally inward over the end riser cleat 86, and a curved clamping rib 88, which extends along the inside surface of the step riser 58 and securely clamps onto the end riser cleat 86. Thus, the step bearing plate 82 is securely clamped to the step 10 along the entire length of its top and front surfaces. This arrangement is also advantageous when the bearing plate 82 is brightly colored to serve as a passenger warning strip, in that the width of this marking strip along the edge of the riser is approximately the same as the width of this marking strip along the edge of the step tread. In the modification shown in FIG. 9, the step bearing plate 82 is only clamped to the step tread 56 by the clamping extension 68. In the modification shown in FIG. 10, the bearing plate 82 is only clamped to the step tread 56 by the plate clamping end 64.

This step bearing plate 82 can be retrofitted on the steps of an existing escalator, so long as the clearance between the back of the steps and the nose of the following step for escalators having smooth risers, or the clearance between the groove on the back of the steps and the cleat of the following step for escalators having cleated risers, is sufficient to accommodate the inwardly extending front section 84 of the bearing plate 82. Also, this step bearing plate 82 can definitely be used on newly manufactured escalators, since the steps can be designed to have the necessary clearance for this front end portion 84 of the plate 82.

Separate tread bearing plates and riser bearing plates may be used instead of single step bearing plates such as the plates 60 or 82. For example FIG. 11 shows a step tread bearing plate 90, which is similar or identical to the top end portion of the step bearing plate 60 and clamps onto the end cleat 62 of the step tread 56, and a riser bearing plate 92 which is similar or identical to the front end portion of the step bearing plate 82 and clamps onto the end cleat 86 of the step riser 58. Both the tread bearing plate 90 and the riser bearing plate 92 extend inwardly several inches from the outer surfaces of the tread 56 and the riser 58, respectively. The riser bearing plate has a top end which is disposed to extend along the front bottom edge of the tread bearing plate 90.

Bearing plates similar to the tread bearing plate 90 may also be used in a lateral guidance system for a moving walk constructed of articulated rigid segments or platforms such as described in U.S. Pat. No. 3,191,743, issued on June 29, 1965 to Rissler et al, to reduce noise and vibration caused by lateral shifting of the moving walk segments. In such an application, laterally-adjustable rigid stationary skirt or bearing panels would be disposed on either side of the moving walk segments, and segment bearing plates, similar to the tread bearing plate 90 shown in FIG. 11, would be affixed to each side of every moving walk segment to bear against, and be guided by, the adjacent stationary skirt panel.

The step bearing plates may be mounted to the steps 10 so that they can be moved laterally for a limited short distance, and a biasing force device, such as a spring, can be used to exert a relatively weak force outwardly on the bearing plate to maintain the bearing plate against the adjacent skirt panel 18 until the bearing plate wears down enough to allow the bearing plate to move to its outermost position. When this occurs, the skirt panels 18 can be adjusted inwardly to return the step bearing plates to their innermost position. By using such an arrangement, the operating clearance gap between each skirt panel 18 and the steps 10 can be eliminated. Alternatively, instead of using one or more springs to bias the step bearing plate outward, the step bearing plate can be formed to provide its own bias force. For example, FIGS. 12 and 13 show a step bearing plate 100, which is similar to the bearing plate 60 except that it includes a top inwardly-extending portion 102 having two ribs 104, 106 which extend downwardly into the end tread slot 66 and the adjacent tread slot 108 to securely grip the second riser cleat 110. The rib 104 is formed to provide a bias force to move the bearing plate 100 to its outermost position, shown in FIG. 12, unless restrained by the adjacent skirt panel 18. Preferably, this bias force should be a relatively weak force, so as not to cause excessive wearing of the plate 100.

In another embodiment of the invention, shown in FIGS. 14 and 15, raised "curb" members of long wearing, low friction, self-lubricating, resilient materials such as TFE flourocarbons and similar materials discussed above, are affixed to, and extend along the entire length of the lateral edges of each escalator step 10 adjacent the skirt panels 18. The curb member 112 has an inwardly and outwardly extending portion 114, which extends to an outer edge or side 116 contacting the adjacent skirt panel 18. The top and bottom sides of the extending portion 114 of the curved member 112 may be flat, concave or convex, as shown in FIGS. 15–19. Also, the curved member 112 may include two ribs 118, 120 which extend downwardly to securely grip either the end cleat 62 or the adjacent cleat 110, as also shown in FIG. 15–19. The curb member 112 can be brightly colored, for example, it can be yellow, to serve as a visual warning device for escalator passengers.

The primary purpose of the curb members 112 is to close the gaps 118, rather than to serve as bearing plates for forming, with the skirt panels 18, a lateral guidance system for the escalator step 10. Even if a small gap does develop between the outer end 116 of the curb member 112 and the adjacent skirt panel 18, whenever a passenger steps on the curb member 112, the weight of the passenger will cause the extending portion 114 of the curb member 112 to deflect downwardly and outwardly, to thus move the outer end 116 firmly against the adjacent skirt panel 118.

Also, when a passenger steps on the inclined top surface of the curb member 112, due to the low coefficient of friction of the curb member 112 and depending on the type of shoe sole, the passenger's show will slide inwardly on the inclined top surface of the curb member 112. Thus, these curb members 112 may also serve as passenger guiding devices.

The curb members 112 may be used in conjunction with step bearing plates, either separately, as shown in FIG. 20, or as an integral part of the step bearing plate, as shown in FIG. 21. When these curb members 112 are installed on an escalator in current use, the end sections of the top and bottom comb plates 24 must be modified to allow these curb members to move past and under these comb plates without interference.

It is obvious that many modifications, varifications, and additions can be made to the specific embodiments described above without departing from the spirit and scope of the invention. Therefore it is intended that the scope of the invention be limited by the appended claims.

What is claimed and desired to be secured by Letters Patent of the United States is:

1. In a passenger conveyor for continuously conveying passengers along a path of travel extending between two landings at respective opposite ends of the conveyor, which includes drive means and an endless series of rigid articulated passenger platforms which are continuously moved in sequence along the path of travel by the drive means, a guidance system for laterally guiding each platform moving along said path of travel, which comprises:

two stationary skirt panels which extend between the two landings adjacent respective opposite lateral sides of the platforms being moved along said path of travel and which respectively include two smooth, planar, inwardly-facing, bearing surfaces of a first material disposed in respective parallel vertical planes extending along said path of travel; and said series of platforms, each platform including two smooth, planar, outwardly-facing bearing surfaces of a second material disposed on respective lateral sides of the platform in parallel vertical planes extending along said path of travel, the bearing surfaces of each platform moving along said path of travel being disposed in sliding contact with respective adjacent skirt panel bearing surfaces.

2. A guidance system, as described in claim 1, wherein at least one of the said first and second materials comprises a resilient plastic material having a low efficient of friction.

3. In a passenger conveyor for continuously conveying passengers along a path of travel extending between two landings at respective opposite ends of the conveyor, which includes drive means and an endless series of rigid articulated passenger platforms which are continuously moved in sequence along the path of travel by the drive means, a guidance system for laterally guiding each platform moving along said path of travel, which comprises:

two stationary skirt panels which extend between the two landings adjacent respective opposite lateral sides of the platforms being moved along said path of travel and which respectively include two smooth, planar, inwardly-facing, lateral surfaces disposed in parallel vertical planes; and two bearing plates disposed on the opposite lateral sides of each platform, respectively, each bearing plate being formed of plastic material having a low coefficient of friction and including an outwardly-facing vertical planar lateral surface which is in sliding contact with the inwardly-facing lateral surface of the adjacent stationary skirt panel.

4. A guidance system, as described in claim 3, wherein the passenger conveyor is an escalator and the passenger platforms are escalator steps, each comprising a top, horizontal tread and a front, generally vertical riser.

5. A guidance system, as described in claim 4, wherein each bearing plate extends along the entire length of the tread and riser lateral sides which is exposed or accessible to passengers.

6. A guidance system, as described in claim 5, wherein each bearing plate extends inwardly several inches from the exposed tread and riser lateral sides of the escalator step.

7. A guidance system, as described in claim 6, wherein each bearing plate comprises an integral top clamp member for clamping the bearing plate to an adjacent end riser cleat of the step tread.

8. A guidance system, as described in claim 7, wherein each bearing plate comprises an integral side clamp member extending inwardly beneath the step tread lateral side, for clamping the bearing plate to the tread lateral side.

9. A guidance system, as described in claim 6 or 7, wherein each bearing plate comprises an integral front clamp member for clamping the bearing plate to the step riser.

10. A guidance system, as described in claim 3, wherein the resilient plastic material of the bearing plates has a coefficient of friction not exceeding 0.3.

11. A guidance system, as described in claim 3, wherein the resilient plastic material of the bearing plates comprises TFE fluorocarbon material.

12. A guidance system, as described in claim 3, wherein the resilient plastic material of the bearing plates comprises nylon and a solid lubricant filler.

13. A guidance system, as described in claim 3, wherein the resilient plastic material of the bearing plates comprises polyethylene.

14. A guidance system, as described in claim 3, wherein the bearing plates are slidably mounted to the lateral sides of the passenger platforms, respectively, for lateral movement between inner and outer limiting positions, and the system further comprises resilient means for exerting a biasing force on each bearing plate in an outward direction.

15. A guidance system, as described in claim 3, wherein the passenger conveyor is a moving walk.

16. A guidance system, as described in claim 3, wherein at least one edge of each bearing plate is marked to indicate a minimum bearing plate thickness.

17. A guidance system as described in claim 5, wherein each bearing plate includes a curved front portion which extends inwardly along the step riser outer surface.

18. A guidance system, as described in claim 7, wherein each bearing plate includes a top portion which extends inwardly along the step tread outer surface.

19. A guidance system, as described in claim 18, wherein the bearing plate material is brightly colored.

20. A guidance system, as described in claim 5, wherein each bearing plate comprises a tread bearing plate disposed on the step tread and a riser bearing plate disposed on the step riser.

21. A guidance system, as described in claim 3, which comprises resilient means for providing a force to press each bearing plate and the adjacent skirt plate together.

22. In a passenger conveyor for continuously conveying passengers along a path of travel between two landings at respective opposite ends of the conveyor, which includes drive means, an endless series of rigid articulated passenger platforms which include respective top tread surfaces and which are continuously moved in sequence along the path of travel by the drive means, and two stationary skirt panels which extend intermediate the two landings adjacent respective opposite lateral sides of the platforms being moved along said path of travel and which include two vertical planar inner lateral surfaces defining with the two opposite lateral sides of the platforms moving therebetween, two running clearance gaps between the lateral sides of the platforms and the two skirt panels, respectively, which are exposed and susceptible to bodily intrusions of a passenger at the lateral edges of the platform top tread surfaces, the combination which comprises:

curb members, which are affixed to the platform top tread surfaces adjacent the exposed running clearance gaps, respectively, each curb member extending the entire length of the adjacent platform lateral side and having an upwardly and outwardly extending portion which extends to an outer edge or side in contact with the planar inner lateral surface of the adjacent skirt panel, each curb member being formed of low friction, resilient material.

23. The combination described in claim 22, wherein the extending portion of each curb member includes upper and lower surfaces which extend upwardly and outwardly to the outer side of the extending portion, and which are shaped so that the weight of a passenger standing on the curb member will produce a downward and outward force on the outer side of the extending portion to press the outer side of the extending portion firmly against the skirt panel.

24. In a passenger conveyor for continuously conveying passengers along a path of travel extending between two landings at respective opposite ends of the conveyor, which includes drive means, an endless series of rigid articulated passenger platforms which are continuously moved in sequence along the path of travel by the drive means, and two stationary, laterally-adjustable skirt panels which extend intermediate the two landings adjacent respective opposite lateral sides of the platforms being moved along said path of travel and which include two smooth, planar, inwardly-extending, lateral surfaces disposed in parallel vertical planes, respectively, a method of laterally guiding each platform moving along said path of travel, which comprises the steps of:

mounting a plurality of bearing plates, which are formed of resilient plastic material having a low coefficient of friction and each of which include a smooth planar outer surface, to the opposite lateral sides of the platforms, respectively, so that each bearing plate outer surface is disposed in a vertical plane and so that all bearing plate outer surfaces are equidistant from a centerline of the platforms along said path of travel; and laterally adjusting the two skirt panels inwardly so that the two outer surfaces of the two bearing plates mounted on opposite sides of each platform moving along said path of travel are in sliding contact with the two inwardly-extending lateral surfaces of the two skirt panels, respectively.

25. The lateral guidance method for a passenger conveyor, as described in claim 24, wherein the passenger conveyor is an existing operating conveyor, which further comprises, before the step of mounting the bearing plates, the steps of:

mounting two panel conditioning plates or blocks, each of which are formed of resilient plastic material having a low coefficient of friction and include a planar outer surface, to the two opposite lateral sides of a selected platform, respectively, so that the two planar outer surfaces of the panel conditioning plates are disposed in respective vertical planes;

laterally adjusting the two skirt panels inwardly so that the two outer surfaces of the two panel conditioning plates press against the two inwardly-extending lateral surfaces of the two skirt panels, respectively;

actuating the drive means to continuously run the selected platform back and forth along the length of the two skirt panels for a period of time sufficient to impregnate microscopic voids and irregularities in the two inwardly-extending lateral surfaces of the two skirt panels with the low friction plastic material of the two panel conditioning plates, respectively.

26. The lateral guidance method for a passenger conveyor, is described in claim 25, wherein:

the step of mounting two panel conditioning plates includes mounting these panel conditioning plates for limited lateral movement between inner and outer limit positions, and applying outwardly directed biad forces to the two panel conditioning plates; and the step of laterally adjusting the two skirt panels inwardly includes adjusting the two skirt panels so that the two panel conditioning plates are disposed inwardly of their respective outer limit positions, so that the two outer surfaces of the two panel conditioning plates are pressed against the two inwardly-extending lateral surfaces of the two skirt panels, respectively, by the outwardly-directed bias forces.

27. The lateral guidance method for a passenger conveyor, as described in claim 25, wherein the passenger conveyor is an existing operating escalator.

* * * * *